US008749335B2

(12) United States Patent
Ueno et al.

(10) Patent No.: US 8,749,335 B2
(45) Date of Patent: Jun. 10, 2014

(54) REACTOR

(75) Inventors: Yasuhiro Ueno, Toyota (JP); Fumio Nomizo, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/813,598

(22) PCT Filed: Jun. 27, 2011

(86) PCT No.: PCT/JP2011/064690

§ 371 (c)(1),
(2), (4) Date: Jan. 31, 2013

(87) PCT Pub. No.: WO2013/001592

PCT Pub. Date: Jan. 3, 2013

(65) Prior Publication Data

US 2013/0127579 A1 May 23, 2013

(51) Int. Cl.

| | |
|---|---|
| ***H01F 17/06*** | (2006.01) |
| ***H01F 27/30*** | (2006.01) |
| ***H01F 27/24*** | (2006.01) |

(52) U.S. Cl.
USPC ..... 336/178; 336/205; 336/208; 336/212

(58) Field of Classification Search
USPC ..... 336/212, 221, 178, 208, 205, 60
See application file for complete search history.

(56) References Cited

U.S. PATENT DOCUMENTS 8,581,685 B2 * 11/2013 Ono ..... 336/221

FOREIGN PATENT DOCUMENTS

| | | | |
|---|---|---|---|
| EP | 2315220 | A1 | 4/2011 |
| JP | 57-035021 | U | 2/1982 |
| JP | 60-061709 | U | 4/1985 |
| JP | 62-219607 | A | 9/1987 |
| JP | 2-056910 | A | 2/1990 |
| JP | 3-038603 | U | 4/1991 |
| JP | 6-045322 | U | 6/1994 |
| JP | 7-007123 | U | 1/1995 |
| JP | 7-130916 | A | 5/1995 |
| JP | 7-283032 | A | 10/1995 |
| JP | 8-057981 | A | 3/1996 |
| JP | 8-181022 | A | 7/1996 |
| JP | 11-204343 | A | 7/1999 |

(Continued)

OTHER PUBLICATIONS

International Search Report of PCT/JP2011/064690 dated Aug. 16, 2011.

*Primary Examiner* — Alexander Talpalatski
*Assistant Examiner* — Mangtin Lian
(74) *Attorney, Agent, or Firm* — Sughrue Mion, PLLC

(57) ABSTRACT

A reactor comprises a reactor core in which two U-shaped core members are connected in a ring shape with gap sections including adhesive layers therebetween, a primary insert-molded resin part which is provided covering leg parts of the core member and which includes joint sections formed around end surfaces of the leg parts a coil placed around the gap sections and the leg parts of the core members, and a secondary insert-molded resin part which is made of a thermoplastic resin and which is insert-molded around the coil to fix the coil on the reactor core and fix the leg parts of the two core members in a connected state, wherein the joint sections of the primary insert-molded resin parts are fitted to each other in a state where the core members are placed connected in a ring shape, to form a peripheral wall surrounding the gap section.

6 Claims, 8 Drawing Sheets

(56) References Cited

FOREIGN PATENT DOCUMENTS

| | | | |
|---|---|---|---|
| JP | 2000-200726 | A | 7/2000 |
| JP | 2003-051414 | A | 2/2003 |
| JP | 2004-095570 | A | 3/2004 |
| JP | 2005-072199 | A | 3/2005 |
| JP | 2007-180140 | A | 7/2007 |
| JP | 2009-027000 | A | 2/2009 |
| JP | 2009-032922 | A | 2/2009 |
| JP | 2009-099793 | A | 5/2009 |
| JP | 2010-103307 | A | 5/2010 |
| JP | 2010-272584 | A | 12/2010 |
| JP | 2011-082412 | A | 4/2011 |
| JP | 2011-086657 | A | 4/2011 |
| JP | 2013-140827 | A | 7/2013 |
| WO | 2013/001593 | A1 | 1/2013 |
| WO | 2013001591 | A1 | 1/2013 |

* cited by examiner

REACTOR

CROSS REFERENCE TO RELATED APPLICATIONS

This application is a National Stage of International Application No. PCT/JP2011/064690 filed Jun. 27, 2011, the contents of all of which are incorporated herein by reference in their entirety.

TECHNICAL FIELD

The present invention relates to a reactor and a manufacturing method thereof, and in particular to a reactor which is equipped in an electric vehicle, a hybrid electric vehicle, or the like, and a manufacturing method thereof.

BACKGROUND ART

Conventionally, there exists a structure in which a reactor is incorporated in a part of an electric power conversion circuit equipped on an electrically driven vehicle such as a hybrid electric vehicle. This reactor is used, for example, for a converter or the like which boosts a voltage of direct current electric power supplied from a battery and outputs the resulting electric power to the side of a motor which is a source of motive force.

In general, a reactor comprises a plurality of core members made of magnetic materials, a reactor core formed by connecting the core members in a ring shape with a non-magnetic gap plate therebetween, and a coil placed around a coil attachment position of the reactor core including the gap plate. The reactor including the reactor core and the coil is equipped on a vehicle, for example, in a state where the reactor is fixed using a bolt or the like in a casing made of a metal such as an aluminum alloy.

As a related art document related to the above-described reactor, JP 2009-99793 A (Patent Literature 1) discloses a method of manufacturing a reactor in which a reactor core having a coil is stored and fixed in a housing, and a silicone resin is impregnated and cured between the housing, reactor core, and coil, to fix the reactor in the housing. In the reactor disclosed in this reference, the reactor core is formed in an overall circular ring shape by fixing the ends of U-shaped cores by an adhesive and with the gap plate therebetween.

JP 2009-32922 A (Patent Literature 2) discloses a reactor core having a plurality of magnetic core members and non-magnetic gap plates interposed between adjacent core members, wherein an opposing surface of the core member and an opposing surface of the gap plate are fixed via an adhesive layer, and the pulling transmission means of leaking magnetic flux is formed on a peripheral surface other than the opposing surface of the gap plate, for pulling the leaking magnetic flux leaking from the core member and applying the leaking magnetic flux to the adjacent core member.

RELATED ART REFERENCES

Patent Literature

[Patent Literature 1] JP 2009-99793 A
[Patent Literature 2] JP 2009-32922 A

DISCLOSURE OF INVENTION

Technical Problem

In the reactors of above-described Patent Literatures 1 and 2, the reactor core of a ring shape is formed by adhering and fixing the core members by an adhesive and with non-magnetic gap plates therebetween. When a thermosetting adhesive is used as the adhesive, the curing process would require a long period of time, and a large number of jigs have been required for maintaining the reactor core assembled in the ring shape in the pressurized state until the adhesive is cured.

An advantage of the present invention is provision of a reactor and a manufacturing method thereof in which the reactor core can be firmly adhered and fixed without the need for jigs for maintaining the reactor core.

Solution to Problem

According to one aspect of the present invention, there is provided a reactor comprising a reactor core in which two U-shaped core members are connected in a ring shape with a gap section including an adhesive layer therebetween, a primary insert-molded resin part which is provided covering at least outer periphery surfaces of leg parts of the core member other than adhesion surfaces of the core member and which includes a joint section formed around end surfaces of the leg parts which form the adhesion surface, a coil which is placed around the gap section and the leg part of the core member, and a secondary insert-molded resin part which is made of a thermoplastic resin and which is insert-molded around the coil to fix the coil on the reactor core and fix the leg parts of the two core members in a connected state, wherein the joint sections of the primary insert-molded resin parts are fitted to each other in a state where the core members are placed connected in a ring shape, to form a peripheral wall surrounding the gap section.

According to another aspect of the present invention, preferably, in the reactor, a frame-shaped inner recess is formed on one of two joint sections, of the primary insert-molded resin parts, which are fitted to each other, and a frame-shaped projection which is fitted to the inner recess is formed on the other one of the two joint sections.

According to another aspect of the present invention, preferably, in the reactor, a bottom surface of the inner recess and a tip surface of the projection are in contact with each other, to define a size of the gap section.

According to another aspect of the present invention, preferably, in the reactor, the gap section is formed with only the adhesive layer.

According to another aspect of the present invention, preferably, in the reactor, a gap for venting air from the gap section is formed between the inner recess and the projection which are recess-projection fitted to each other.

According to another aspect of the present invention, preferably, in the reactor, a channel section into which redundant adhesive can enter from the gap section is formed on at least one of a bottom surface of the inner recess and a tip surface of the projection.

According to another aspect of the present invention, preferably, in the reactor, of two leg parts of one of the U-shaped core members, the inner recess is formed on the joint section of the primary insert-molded resin part of one of the leg parts and the projection is formed on the joint section of the primary insert-molded resin part of the other leg part.

According to another aspect of the present invention, there is provided a method of manufacturing a reactor having a reactor core in which two U-shaped core members are connected in a ring shape with a gap section including an adhesive layer therebetween and a coil provided around the reactor core including the gap section, the method comprising preparing the two core members and the coil, insert-molding a thermoplastic resin for each of the core members, to form a primary insert-molded resin part covering at least outer periphery surfaces of leg parts of the core member other than adhesion surfaces and including a joint section around end surfaces of the leg parts which form the adhesion surfaces, placing the core members connected in a ring shape with the gap sections therebetween in a state in which the leg parts of the core member are passed through the coil, wherein the joint sections of the opposing leg parts of the two core members are fitted to each other to form a peripheral wall surrounding the gap section, and the opposing leg parts are adhered to each other by the adhesive layer included in the gap section, and insert-molding a thermoplastic resin around the coil to form a secondary insert-molded resin part which fixes the coil on the reactor core and fixes the leg parts of the two core members in a connected state.

According to another aspect of the present invention, preferably, in the method of manufacturing a reactor, the adhesive layer is formed with a thermosetting adhesive, and a molding tool is brought into contact with the end surfaces of the leg parts of the core member during the formation of the primary insert-molded resin part, to pre-heat the core member.

According to another aspect of the present invention, preferably, in the method of manufacturing a reactor, the adhesive layer formed with the thermosetting adhesive is cured using heat during the formation of the secondary insert-molded resin part.

Advantageous Effects of Invention

According to a reactor and a manufacturing method thereof of various aspects of the present invention, the joint sections of the primary insert-molded resin parts are fitted to each other to form a peripheral wall surrounding the gap section when the core members are placed connected in a ring shape. Because of this flow of the melted thermoplastic resin into the gap section during the formation of the secondary insert-molded resin part can be suppressed, and the core members can be firmly adhered and fixed by the adhesive layer provided in the gap section. In addition, because the leg parts of the core members are fixed in a connected state by the secondary insert-molded resin part, a jig for pressurizing and maintaining the reactor core from both sides during the time required for curing the adhesive can be made unnecessary.

DESCRIPTION OF EMBODIMENTS

A preferred embodiment of the present invention (hereinafter simply referred to as "embodiment") will now be described in detail with reference to the attached drawings. In this description, the specific shape, material, numerical value, direction, etc., are merely exemplary for facilitating understanding of the present invention, and may be suitably changed according to usage, objective, specification, etc. In addition, when a plurality of embodiments and alternative configurations are included in the following description, it is conceived that characteristic portions of these embodiments and configurations may be used in a suitable combination.

Figure 1:
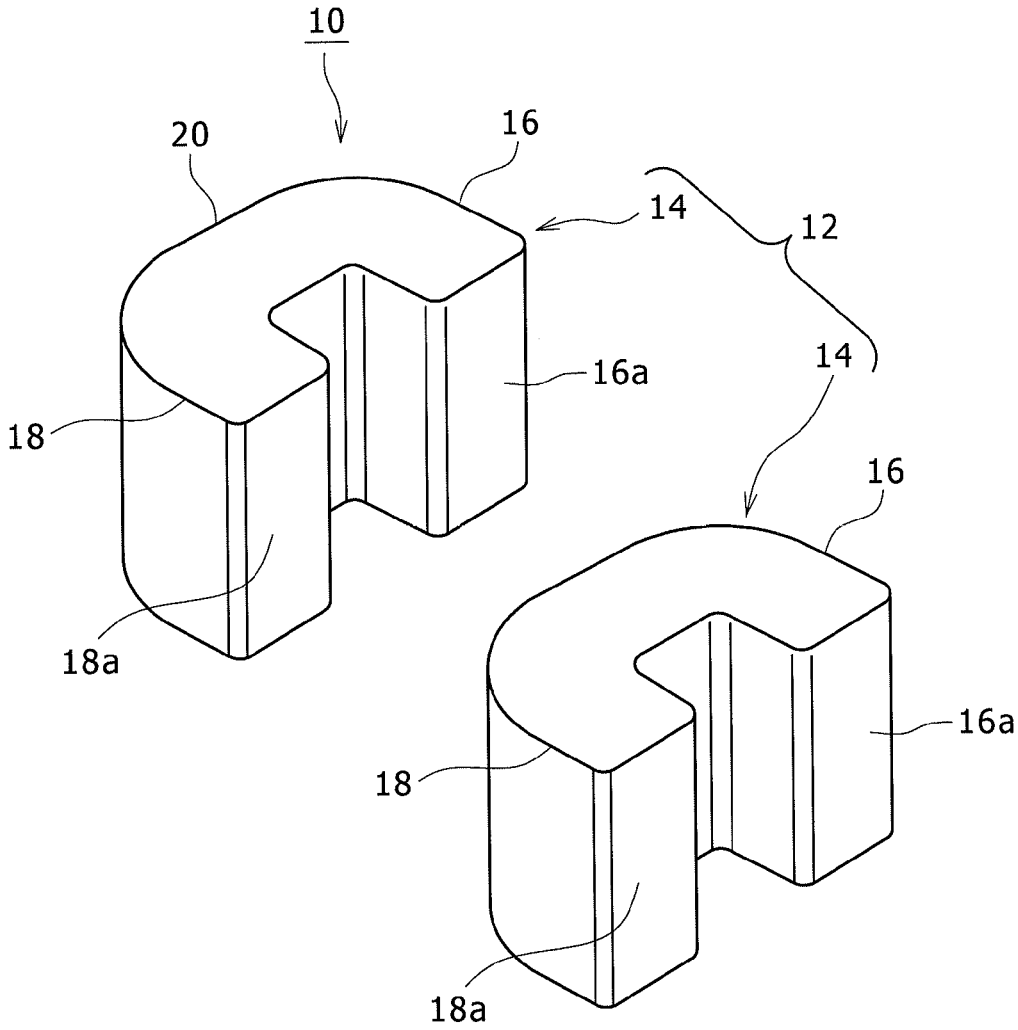
FIG. 1 is a perspective diagram showing core members of a reactor core of a reactor according to a preferred embodiment of the present invention.

FIG. 1 is a perspective diagram showing core members 14 of a reactor core 12 in a reactor 10 according to an embodiment of the present invention. The reactor core 12 in the present embodiment comprises two U-shaped core members 14 having the same shape.

The core member 14 comprises a first leg part 16 and a second leg part 18 which protrude parallel to each other, and a connecting section 20 connecting the leg parts 16 and 18 and having an approximate arc shape in a plan view. In addition, the core member 14 is preferably formed by a pressed powder core formed by mixing and pressure-molding a resin-coated magnetic powder and a binder. Alternatively, the core member 14 may be formed by a layered structure of steel plates in which a large number of electromagnetic steel plates stamped in an approximate U-shape are layered and integrally connected by calking or the like.

The first and second leg parts 16 and 18 of the core member 14 have rectangular end surfaces 16*a* and 18*a*, respectively. The end surfaces 16*a* and 18*a* become adhesion surfaces of the core members when two core members 14 are abutted in an approximate ring shape with the gap section therebetween.

Figure 2:
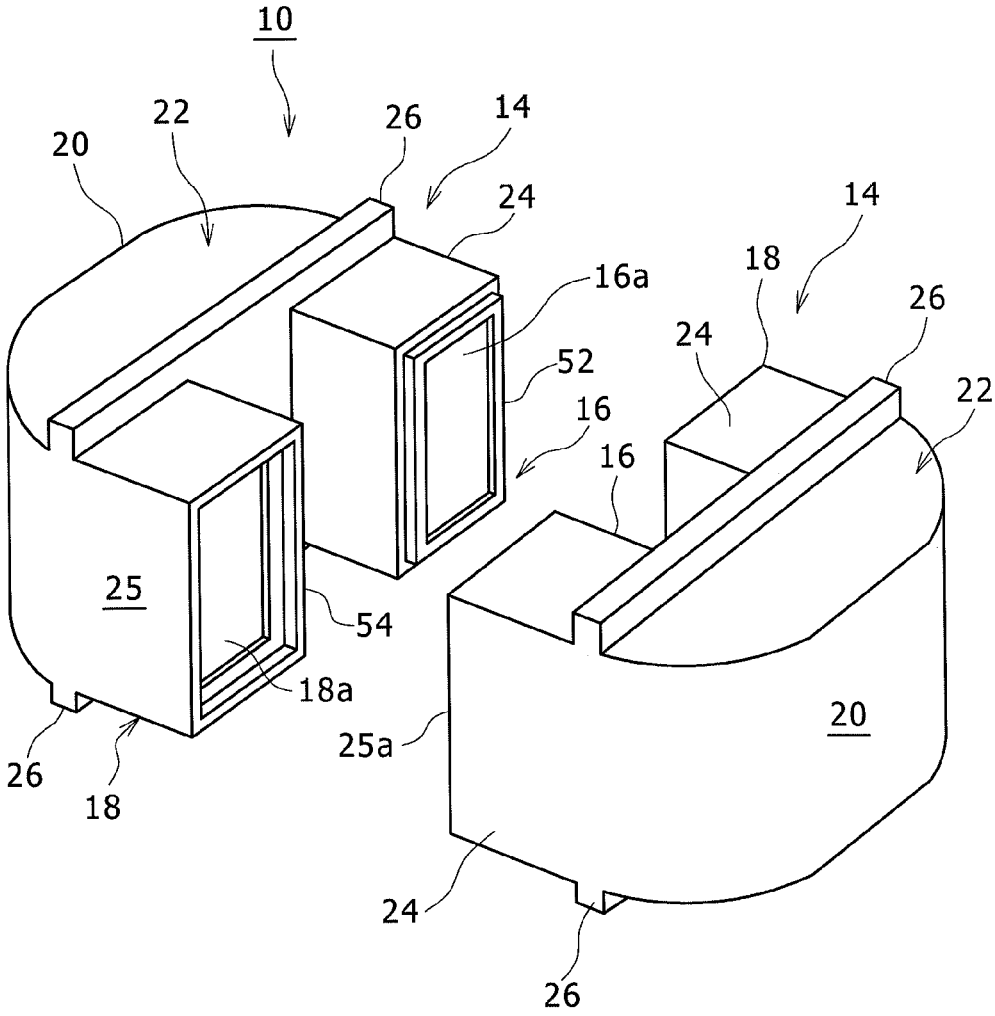
FIG. 2 is a perspective diagram showing a state in which a primary insert-molded resin part made of a thermoplastic resin is formed on the core member of FIG. 1.

FIG. 2 is a perspective diagram showing a state in which a primary insert-molded resin part 22 made of a thermoplastic resin is formed on the core member 14 of FIG. 1. In the core member 14, the entirety of an outer periphery surface other than the end surfaces 16*a* and 18*a* of the leg parts is covered by the primary insert-molded resin part 22. The primary insert-molded resin part 22 has a protection function to prevent damages to the core member 14 made of pressed powder core which has a relatively low hardness and which tends to be chipped, and also a function to secure an insulating characteristic between the core member 14 and a metal casing when the reactor is attached to the metal casing, as will be described later.

The primary insert-molded resin part 22 is formed by placing the core member 14 in a molding tool and injection-molding the thermoplastic resin. In two core members 14, in each of which the primary insert-molded resin part 22 is formed, the first leg part 16 and the second leg part 18 are placed to oppose each other when the two core members are assembled.

The primary insert-molded resin part 22 includes leg covering sections 24 and 25 covering the periphery around the first and second leg parts 16 and 18. The leg covering sections 24 and 25 have a function to ensure an insulating distance between the coil and the reactor core when the coil is placed around the leg parts 16 and 18, as will be described later.

In addition, the primary insert-molded resin part 22 includes wall sections 26 which protrude from upper and lower surfaces, respectively. The wall section 26 has a function to position the coil by approximately contacting the coil end surface when the coil is placed around the leg parts 16 and 18. Here, "approximate contact" means that a slight gap is formed to allow a melted thermoplastic resin for a secondary insert-resin molded part to flow into an inner periphery side of the coil.

Moreover, the leg covering section 24 of the first leg part 16 in the primary insert-molded resin part 22 includes a joint section 52 formed around the end surface 16*a* of the leg part and protruding in a rectangular frame shape, and the leg covering section 25 of the second leg part 18 includes a joint section 54 formed around the end surface 18*a* of the leg part and protruding in a rectangular frame shape. The joint sections 52 and 54 are recess-projection fitted to each other when the two core members 14 are connected in a ring shape by the leg parts, to form a peripheral wall surrounding the periphery of the gap section.

In the core member 14 of the present embodiment, the joint section 52 of a protruded shape is formed on the first leg part 16 and the joint section 54 of a recess shape is formed on the second leg part 18. With such a configuration, the primary insert-molded resin parts 22 of the same shape may be formed for the two core members 14 of the reactor core 12, and there is an advantage that only one type of molding tool for the primary insert-molding is required. However, the present invention is not limited to such a configuration, and alternatively, two types of molding tools may be used to form the projecting joint sections on two leg parts of one of the core members 14 and form the recess joint sections on the two leg parts of the other core member.

Figure 3:
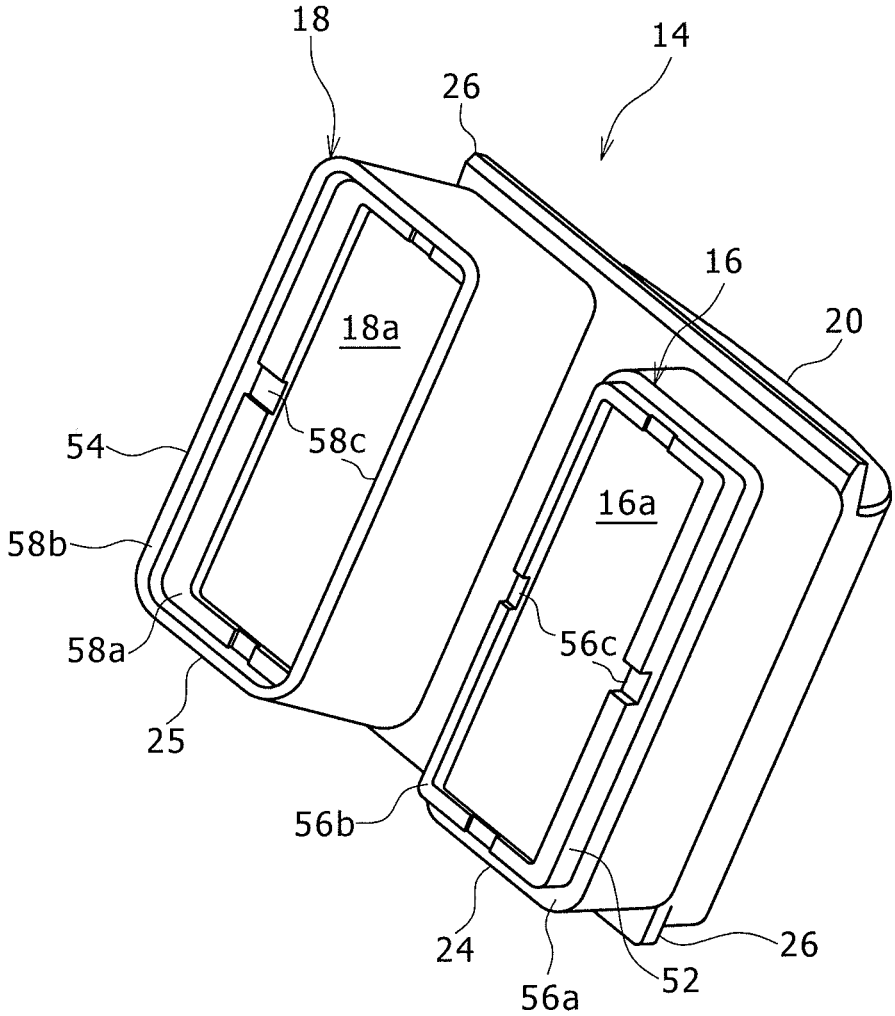
FIG. 3 is a perspective diagram showing a shape of a joint section of a primary insert-molded resin part which is formed on a core member.

The joint sections 52 and 54 will now be described in detail with reference to FIG. 3. FIG. 3 is a perspective diagram showing shapes of the joint sections 52 and 54 of the primary insert-molded resin part 22 formed on the core member 14.

On the joint section 52 formed on the first leg part 16, a step 56*a* is formed on an outer periphery, and with this structure, an inner protrusion 56*b* having a rectangular frame shape and having a thickness of approximately half or less of the joint section 52 is formed. At a center in the longitudinal direction of each of four sides of the inner protrusion 56*b*, a shallow channel section 56*c* is formed. The position and the number of the channel sections 56*c* in the inner protrusion 56*b* may be suitably changed to allow redundant adhesive to leak and accumulate from the gap section when the reactor is assembled, as will be described later. For example, the channel section 56*c* may be formed at a corner section of the inner protrusion 56*b*.

On the joint section 54 formed on the second leg part 18, a step 58*b* is formed as an inner recess at the inner periphery, and with this structure, an outer protrusion 58*b* having a rectangular frame shape and having a thickness of approximately half or less of the joint section 54 is formed. At a center in the longitudinal direction of each of four sides of the step 58*a*, a shallow channel section 58*c* is formed. The channel sections 58*c* are formed at positions opposing the channel sections 56*c* when the joint section 54 is connected to the joint section 52 and in the same number as the channel sections 56*c*.

In the present embodiment, the channel sections 56*c* and 58*c* are formed on both of the joint sections 52 and 54, but the present invention is not limited to such a configuration. Alternatively, the channel section may be formed on only one of the joint sections.

Figure 4:
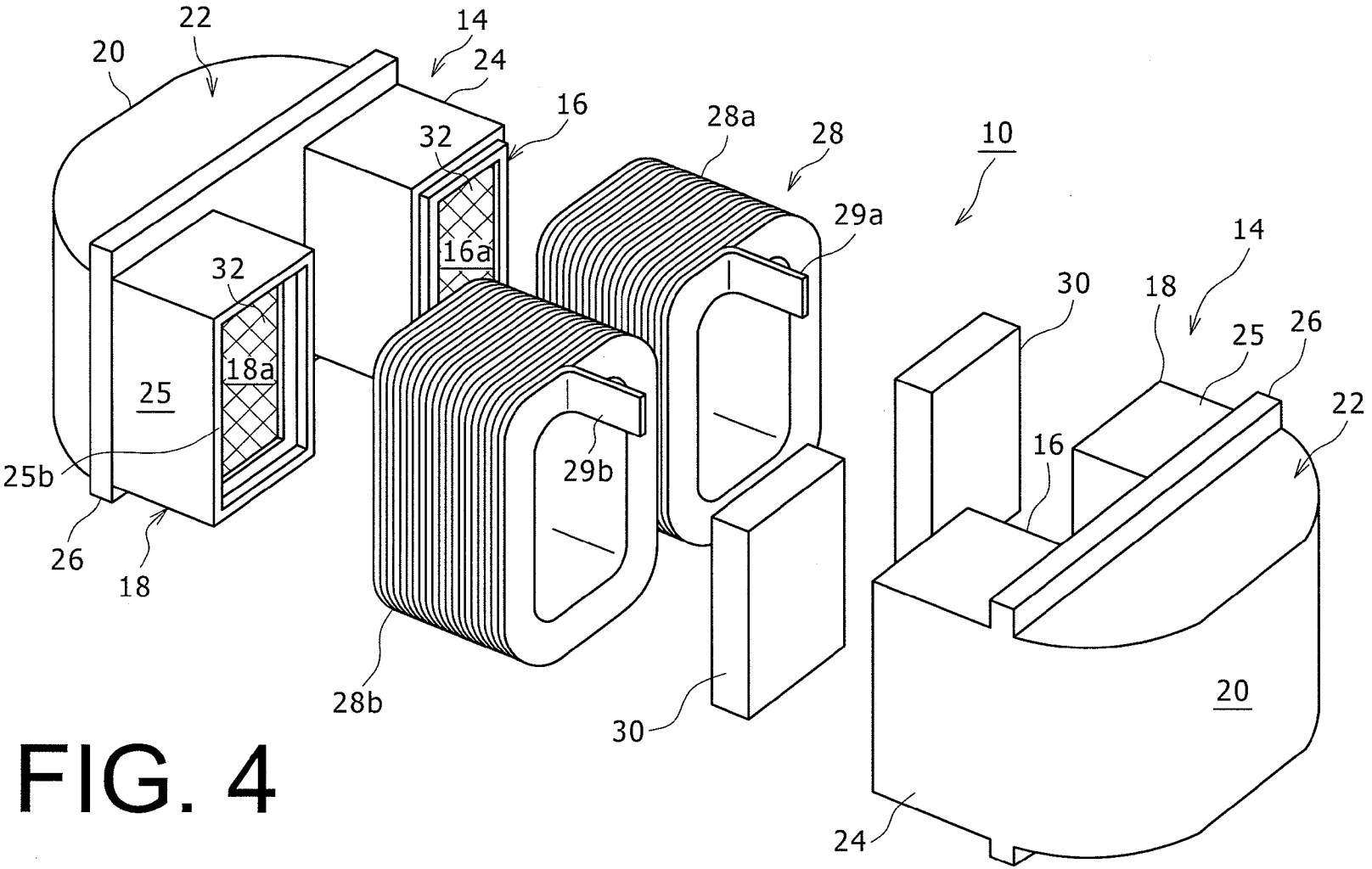
FIG. 4 is an exploded perspective diagram showing assembly of two core members in which primary insert-molded resin parts are formed, a coil, and two gap plates.

FIG. 4 is an exploded perspective diagram showing assembly of the two core members 14 in which the primary insert-molded resin part 22 is formed, a coil 28, and two gap plates 30.

The coil 28 of the reactor 10 of the present embodiment is, for example, an edgewise type coil which is formed in advance by winding, around a former, a flat polygon conductor which has been subjected to insulating coating processing with enamel or the like, and comprises two coil sections 28*a* and 28*b* which are connected in series. The coil sections 28*a* and 28*b* are formed by winding one continuous flat polygon conductor.

More specifically, when a conductor end 29*a* of one coil section 28*a* is the start of the winding, the flat polygon conductor is wound from the winding start in a counterclockwise direction to form the coil section 28*a*, the flat polygon conductor is wound from the coil section 28*a* to the other coil section, coil section 28*b*, in the clockwise direction, to form the coil section 28*b*, and the flat polygon conductor is continued to a winding completion end 29*b*. The conductor ends 29*a* and 29*b* protruding from the coil sections 28*a* and 28*b* in this manner are connected to input and output terminals of the electric power for the coil 28 (that is, the reactor 10).

The coil sections 28*a* and 28*b* are formed in an inner periphery shape of an approximate rectangular shape which is slightly larger than the leg covering sections 24 and 25 formed on an outer periphery of the leg parts 16 and 18 of the core member 14. With this configuration, it becomes possible to pass the leg parts 16 and 18 of the core members 14 through the inside of the coil sections 28*a* and 28*b*. In addition, the lengths of the coil sections 28*a* and 28*b* in the winding direction are formed to be slightly shorter than a distance between the wall sections 26 of the primary insert-molded resin parts 22 of the two core members 14 connected in a ring shape. With this configuration, when the reactor core 12 is assembled, the coil sections 28*a* and 28*b* can be positioned with a slight clearance in the area between the two wall sections 26.

The gap plate 30 is a flat-plate member made of a non-magnetic material and having a rectangular shape, and, for example, a ceramic plate such as alumina is preferably used. On the end surfaces 16*a* and 18*a* of the leg parts of the core member 14 when the reactor is assembled, an adhesive layer 32 which is shown in FIG. 4 by cross-hatching on one of the core members 14 is applied or formed. With this configuration, when the leg parts 16 and 18 are passed through the coil sections 28*a* and 28*b* and the two core members 14 are assembled in the ring shape, the two core members 14 are adhered with the adhesive layer 32 therebetween, in a state where the gap plate 30 is sandwiched between the end surfaces 16*a* and 18*a* of the first leg part 16 and the second leg part 18. Therefore, in the reactor 10 of the present embodiment, the gap section 31 formed between the two core members 14 is formed with the gap plate 30 and the adhesive layer 32 (refer to FIG. 7).

For the adhesive layer 32, a material having a strong adhesion force and having a superior heat endurance such as, for example, a thermosetting adhesive such as an epoxy-based rein or the like is preferably used. In the case when the thermosetting adhesive is used also, the adhesive can be sufficiently cured using the heat of melted resin forming the secondary insert-molded resin part as will be described later, and the adhesion strength can be quickly secured.

The adhesive forming the adhesive layer 32 is not limited to a thermosetting adhesive, and, for example, a room temperature setting adhesive may alternatively be used. In addition, with regard to the adhesive layer 32, because the gap size between the end surfaces 16*a* and 18*a* of the first and second leg parts 16 and 18 which oppose each other is accurately defined by the recess-projection fitting of the joint sections 52 and 54 of the primary insert-molded resin parts 22 when the two core members 14 each having the primary insert-molded resin part 22 are connected, the gap plate may be omitted and the gap section may be formed with only a predetermined amount of the adhesive. With such a configuration, advantages can be obtained such as that the number of components and the cost can be reduced and that the assembly can be facilitated.

Figure 5:
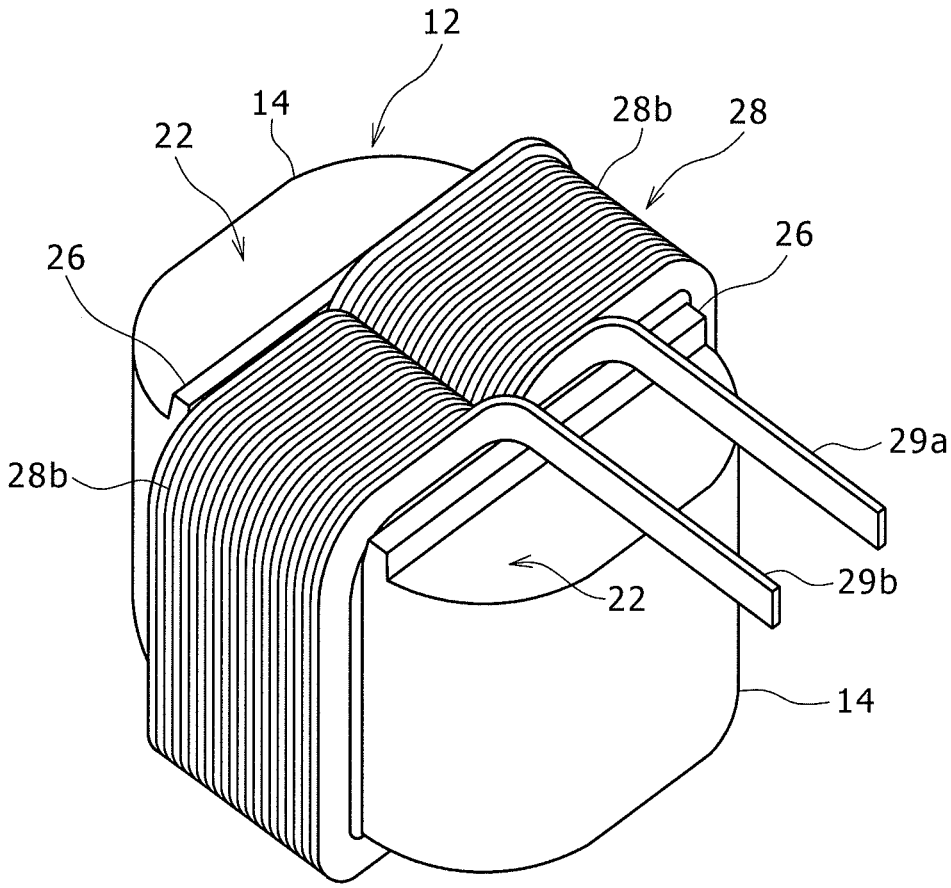
FIG. 5 is a perspective diagram showing a reactor core and a coil in a state where a core member in which a primary insert-molded resin part is formed, a coil, and a gap plate are assembled.

FIG. 5 is a perspective diagram showing the reactor core 12 and the coil 28 in a state where the core member 14 in which the primary insert-molded resin part is formed, the coil 28, and the gap plate 30 are assembled. When the two core members 14 are connected by passing the leg parts 16 and 18 through the coil sections 28*a* and 28*b* and with the gap plate 30 and the adhesive layer 32 therebetween as described above, the reactor core 12 in which two core members 14 are connected in a ring shape with the gap section therebetween and the coil 28 which is placed around the leg parts 16 and 18 including the gap section in the reactor core 12 are assembled.

Figure 6:
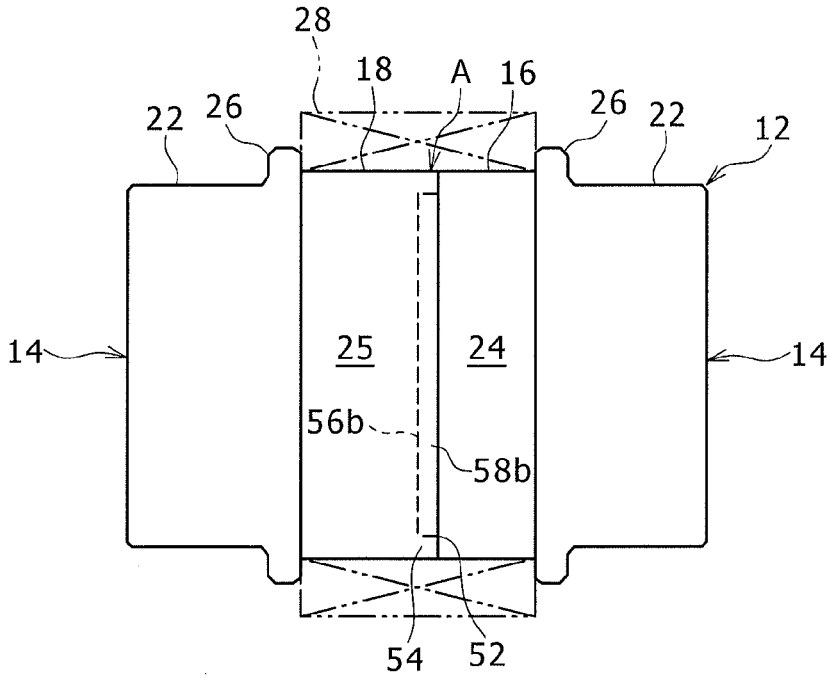
FIG. 6 is a side view showing a state where two core members in which a primary insert-molded resin part is formed are recess-projection fitted to each other at joint sections, and connected.
Figure 7:
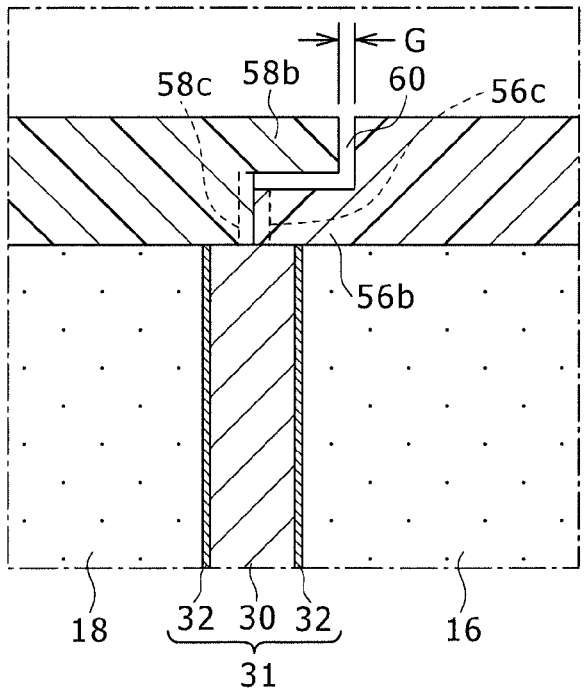
FIG. 7 is an enlarged cross sectional view of an A section in FIG. 6 showing the recess-projection fitted state of the joint sections of the primary insert-molded resin parts.

With reference to FIGS. 6 and 7, the connection state of the joint sections 52 and 54 in the two core members 14 will be described in detail. FIG. 6 is a side view showing a state where two core members 14 in which the primary insert-molded resin part 22 is formed are recess-projection fitted at the joint sections and connected. In FIG. 6, the coil 28 is shown by a virtual dot-and-chain line. FIG. 7 is an enlarged cross sectional view of an A section in FIG. 6 showing the recess-projection fitted state of the joint sections 52 and 54 of the primary insert-molded resin part 22.

As shown in FIG. 6, when the first leg part 16 and the second leg part 18 are connected, the joint section 52 of the leg covering section 24 which is a part of the primary insert-molded resin part and the joint section 54 of the second leg part 18 are recess-projection fitted to each other. More specifically, the inner projection 56*b* formed on the joint section 52 is fitted to the inner step 58*a* formed on the joint section 54. With this configuration, in the two core members 14, the relative positions of the leg part 16 and 18 in the lateral and vertical directions are accurately determined.

In addition, when the core members 14 are connected as described above, as shown in FIG. 7, a tip surface of the inner projection 56*b* of the joint section 52 is brought into contact with the inner step 58*a* of the joint section 54, to position the core members 14 in the opposing direction. With this configuration, the size of the gap section 31 formed by the gap plate 30 and the adhesive layer 32, that is, the distance between the opposing end surfaces 16*a* and 18*a* of the leg parts, is defined to a certain size. Therefore, the reactor core 12 can be assembled with high precision and uniformly. This is also similarly true when the gap plate 30 is not used and the gap section 31 is formed with only the adhesive layer 32.

Moreover, when the joint sections are connected in a manner as described above, a gap 60 for enabling venting of air from the gap section 31 is formed between the inner protrusion 56*b* of the joint section 52 and the outer protrusion 58*b* of the joint section 54. Therefore, when the core members 14 are adhered and fixed with the adhesive layer 32, the air existing in the gap section 31 can be discharged from the gap 60 to the outside. With this configuration, the adhesive layer 32 can be uniformly applied while not leaving air in the gap section 31, and a strong adhesion strength can be ensured. A size G of the gap 60 is preferably set to a size which allows discharge of the air from the gap section 31, but prevents easy intrusion of melted thermoplastic resin for the second insert-molding process, which will be described later. With such a configuration, it is possible to suppress intrusion of the melted thermoplastic resin into the gap section 31 and to prevent reduction of the adhesion strength by the adhesive layer 32.

Furthermore, when the core members 14 are connected in the manner described above, redundant adhesive in the gap section 31 can be received in the channel section 56*c* formed on the inner protrusion 56*b* of the joint section 52 and the channel section 58*c* formed on the inner step 58*a* of the joint section 54. With this configuration, even if the thermosetting adhesive forming the adhesive layer 32 is applied in a slightly larger amount, the size of the gap section 31 can be accurately defined.

Figure 8:
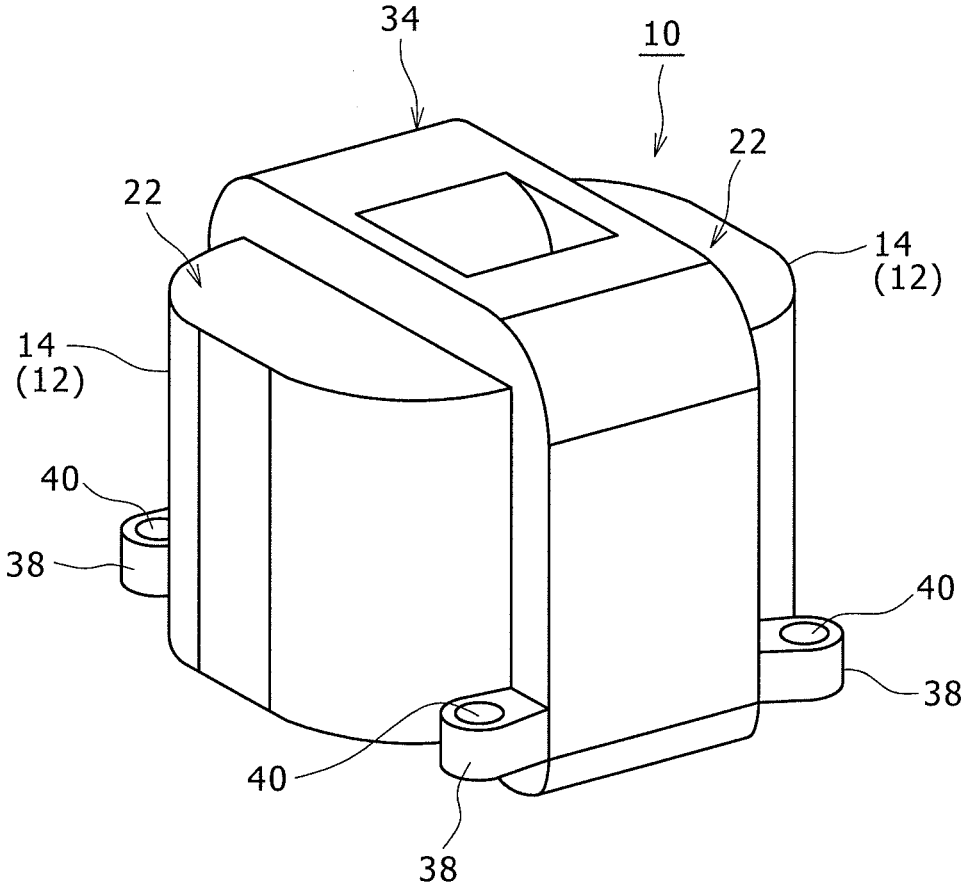
FIG. 8 is a perspective diagram showing a state where a secondary insert-molded resin part is formed on the reactor core and the coil of FIG. 5.

FIG. 8 is a perspective diagram showing a state where the secondary insert-molded resin part 34 is formed in the reactor core 12 and the coil 28 shown in FIG. 5. In FIG. 8, the conductor ends 29*a* and 29*b* protruding and extending from the secondary insert-molded resin part 34 are not shown.

The reactor core 12 and the coil 28 assembled as shown in FIG. 5 are placed on another molding tool, and a thermoplastic resin is injection-molded, to form the secondary insert-molded resin part 34. The secondary insert-molded resin part 34 may be formed with the same thermoplastic resin material as the primary insert-molded resin part 22, or may be formed with a different thermoplastic resin material.

The secondary insert-molded resin part 34 is formed covering approximately the entirety of the periphery of the coil sections 28*a* and 28*b* forming the coil 28. With this configuration, the two coil sections 28*a* and 28*b* of the coil 28 are firmly fixed on the reactor core 12 having a ring shape. In addition, the secondary insert-molded resin part 34 is formed covering a region to an outside of the wall section 26 of the primary insert-molded resin part 22, and therefore, the two core members 14 are reliably fixed to each other in a connected state in a ring shape, due to an anchoring effect of the wall section 26. With this process, the manufacturing of the reactor 10 is completed.

When the secondary insert-molded resin part 34 is formed in the above-described manner, heat of the thermoplastic resin which is melted and which is at a high temperature is effectively used for curing the adhesive layer 32 made of the thermosetting adhesive. Therefore, a step of thermally processing the reactor 10 in a heating furnace for a predetermined time (for example, 2-3 hours) for curing the adhesive layer 32 becomes unnecessary. In this case, in order to sufficiently cure the adhesive layer 32 by the heat in the formation of the secondary insert-molded resin part 34, a thermosetting adhesive which is cured relatively quickly is preferably used.

As shown in FIG. 8, a plurality of attachment sections 38 for attaching the reactor 10 to a reactor attachment member with a bolt are integrally formed with the secondary insert-molded resin part 34 in a protruding manner. In the present embodiment, an example configuration is shown in which four attachment sections 38 are formed. In the attachment section 38, a bolt passing hole 40 is formed in a penetrating manner. By integrally molding the attachment section 38 with the secondary insert-molded resin part 34 in this manner, it becomes unnecessary to specially provide an attachment section made of a metal plate, resulting in reduction in the number of constituting components and reduction of cost. Alternatively, the attachment section may be integrally formed in advance on an exposed section of the primary insert-molded resin part 22 which is not covered with the secondary insert-molded resin part 34.

Figure 9:
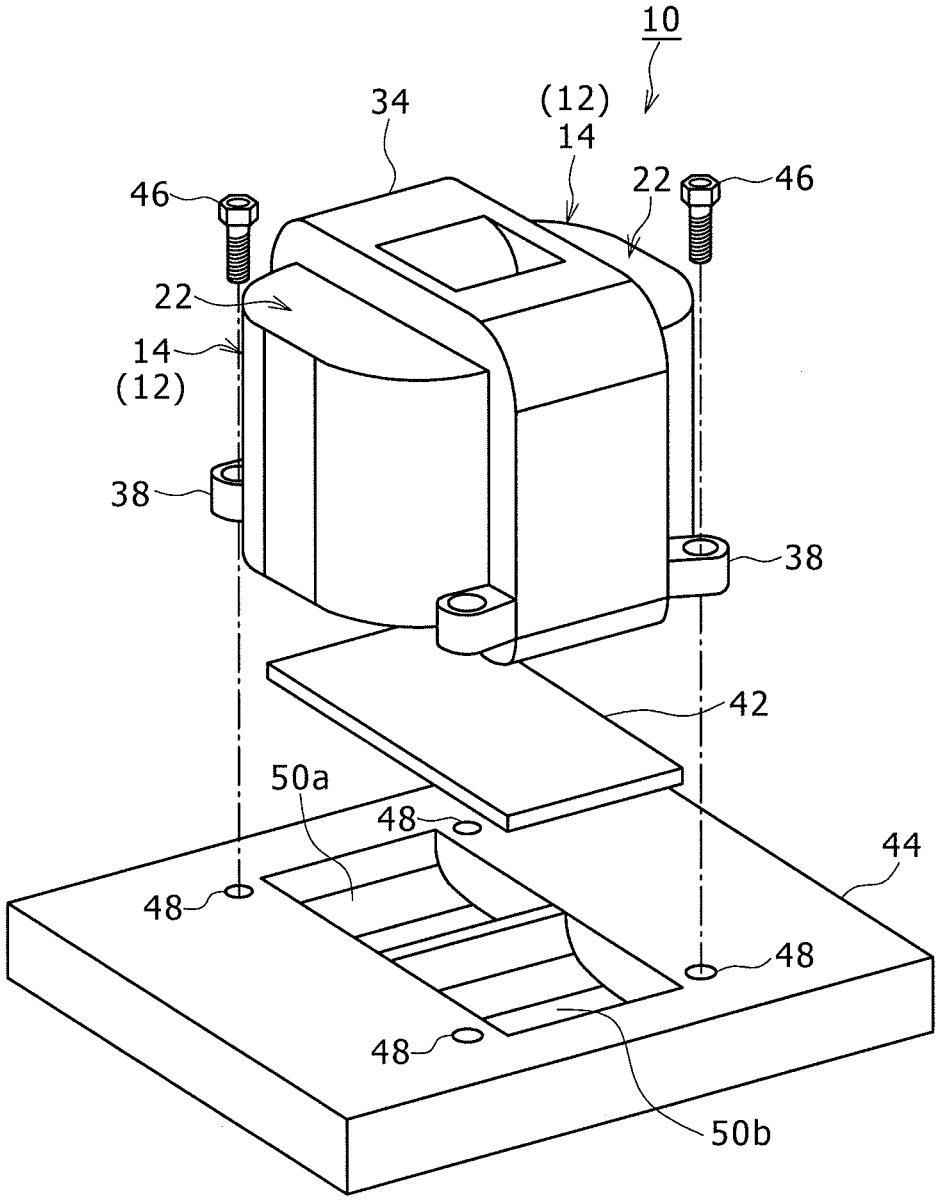
FIG. 9 is an exploded perspective diagram showing fixing of the reactor, in which the coil is fixed, on a bottom plate of a metal casing using a bolt, with a heat dissipation sheet therebetween.

FIG. 9 is an exploded perspective view showing fixing, with a bolt, of the reactor 10, in which the coil 28 is fixed by the secondary insert-molded resin part 34, on a reactor attachment member 44 with a heat dissipation sheet 42 therebetween.

A bolt 46 is passed through the attachment section 38 of the secondary insert-molded resin part 34 and is tightened to a female threaded hole 48 formed on the reactor attachment member, more specifically, a bottom plate 44 of the metal casing made of, for example, an aluminum alloy, so that the reactor 10 manufactured in the above-described manner is fixed on the bottom plate 44 of the metal casing with the heat dissipation sheet 42 sandwiched therebetween.

Attachment recesses 50*a* and 50*b*, having a shape to which lower parts of the coil sections 28*a* and 28*b* of the coil 28 covered by the secondary insert-molded resin part 34 of the reactor 10 are fitted, are formed on the bottom plate 44 of the metal casing. With this configuration, the lower parts of the coil sections 28*a* and 28*b* can be brought into close contact with the bottom plate 44 of the metal casing with the heat dissipation sheet 42 therebetween, and as a result, a superior heat dissipation characteristic from the coil sections 28*a* and 28*b* to the bottom plate 44 of the metal casing can be ensured. In addition, because the heat dissipation sheet 42 also functions as an insulating sheet, the insulating characteristic between the coil sections 28*a* and 28*b* and the bottom plate 44 of the metal casing can also be improved.

Although not shown in FIG. 9, the bottom plate 44 of the metal casing forms a side wall of a cooling device to which cooling water is supplied in a circulating manner, or a cooling device is provided adjacent to the bottom plate 44 of the metal casing on the backside (that is, on a surface opposite to the attachment surface of the reactor 10), so that the bottom plate 44 of the metal casing is forcefully cooled.

In the above, a configuration is described in which the lower parts of the coil sections 28*a* and 28*b* of the coil 28 are covered with the secondary insert-molded resin part 34, but the present invention is not limited to such a configuration, and a configuration may be employed in which only the lower parts of the coil sections 28*a* and 28*b* are not covered with the secondary insert-molded resin part and are exposed, and the coil sections 28*a* and 28*b* are in contact with the bottom plate 44 of the metal casing with the heat dissipation sheet 42 therebetween. With such a configuration, the heat transfer characteristic from the coil 28 to the bottom plate 44 of the metal casing can be improved, and the cooling capability of the coil 28 can be improved. In addition, by forming only the secondary insert-molded resin part with a high heat transfer characteristic resin, an advantage can be obtained that an increase in the cost of the material can be suppressed.

Alternatively, in the above-described configuration, a thermoplastic resin having a higher heat transfer characteristic than the thermoplastic resin used for the primary insert-molded resin part 22 may be used for the thermoplastic resin of the secondary insert-molded resin part 34. In this case, for example, particles with high heat transfer characteristic such as, for example, silica, may be mixed in the thermoplastic resin for the secondary insert-molded resin part, to improve the heat transfer capability. With such a configuration, even if the entire outer periphery of the coil 28 is covered with the secondary insert-molded resin part 34, the heat dissipation characteristic from the coil 28 to the outside can be made superior.

Next, a method of manufacturing the reactor 10 having a structure described above will be described.

First, two core members 14, the coil 28 including the coil sections 28*a* and 28*b*, and two gap plates 30 are prepared (refer to FIGS. 1 and 4). Here, if the gap section 31 is formed with only the adhesive layer 32 as described above, the gap plate 30 is not necessary.

Next, the primary insert-molded resin part 22 made of a thermoplastic resin is formed covering at least the outer periphery surface of the core member 14 other than the adhesion surfaces of the core members (refer to FIGS. 2 and 3). In this process, the molding tool is preferably brought into contact with the end surfaces 16*a* and 18*a* of the leg parts of the core member 14, to pre-heat the adhesion surface of the core member 14. With the pre-heating in this manner, an advantage can be obtained in that curing of the thermosetting adhesive forming the adhesive layer 32 can be promoted. This advantage becomes more significant when combined with the heat insulation effect due to coverage of the periphery with the secondary insert-molded resin part 34 later and the application of the heat during the formation of the secondary insert-molded resin part.

Next, the two core members 14 are placed in an orientation in which the leg parts 16 and 18 oppose each other, the leg parts 16 and 18 are passed through the coil sections 28*a* and 28*b*, and the end surfaces 16*a* and 18*a* of the leg parts 16 and 18 are connected with the gap plate 30 and the adhesive 32 therebetween (refer to FIGS. 4-7).

The secondary insert-molded resin part 34 made of a thermoplastic resin is then formed on the reactor core 12 in which the coil 28 is placed around the gap section, to fix the coil sections 28*a* and 28*b* of the coil 28 on the reactor core 12 and fix the core members 14 in the connected state (refer to FIG. 8). With this process, the manufacturing of the reactor 10 is completed.

As described, in the reactor 10 of the present embodiment, a configuration is employed in which the joint sections 52 and 54 of the primary insert-molded resin parts 22 are recess-projection fitted to form the peripheral wall surrounding the gap section 31 when the two U-shaped core members 14 are connected and placed in a ring shape. Because of this configuration, the flow of the melted thermoplastic resin into the gap section 31 when the secondary insert-molded resin part 34 is formed can be suppressed, and the core members 14 can be firmly adhered and fixed to each other by the adhesive layer 32 provided in the gap section 31. In addition, because the leg parts 16 and 18 of the core members 14 are fixed in a connected state by the secondary insert-molded resin part 34, it becomes no longer necessary to provide the jigs for pressurizing and maintaining the reactor core 12 from both sides during the time required for curing the adhesive.

Moreover, in the reactor 10 of the present embodiment, the thermosetting adhesive can be cured by the pre-heating at the time of formation of the primary insert-molded resin part and the heat of the melted resin during the formation of the secondary insert-molded resin part. Because of this, the thermosetting process in the heating furnace becomes no longer necessary and the heating furnace may be omitted in the manufacturing line for the reactor.

Furthermore, with the configuration where the leg parts 16 and 18 and the coil sections 28*a* and 28*b* placed around the gap section 31 are fixed by the secondary insert-molded resin part 34 made of the thermoplastic resin, the potting process of the thermosetting resin in a vacuum furnace and the heating and curing process in the heating furnace can be omitted, and the reactor manufacturing can be enabled at a high cycle (for example, 40 seconds per reactor).

In addition, in the reactor 10 of the present embodiment, an insulating distance between the coil 28 and the core member 14 is ensured by the primary insert-molded resin part 22 covering the periphery of the leg parts 16 and 18 of the core member 14 on which the coil 28 is attached. With such a configuration, the coil does not need to be assembled to the reactor core in a state where the coil is wound around an insulating resin bobbin, and the resin bobbin can be omitted.

Because of the above, according to the present embodiment, the manufacturing cost of the reactor can be significantly reduced.

In the above, a preferred embodiment and alternative configurations of the present invention have been described. The reactor of the present invention is not limited to the above-described configurations, however, and various modifications and improvements can be applied.

For example, in the above description, the primary insert-molded resin part 22 is formed covering the entire outer periphery of the core member 14 other than the end surfaces 16*a* and 18*a* of the leg parts. However, the primary insert-molded resin part 22 is not limited to such a configuration, and the primary insert-molding may be applied only in portions corresponding to the leg covering section 24 and the wall section 26, and the entirety or a part of the connecting section 20 of the core member 14 may be exposed. By exposing the core member in this manner, an advantage can be obtained that a heat dissipation characteristic from the core member is improved.

In addition, with regard to the secondary insert-molded resin part 34 also, a window section may be provided which exposes a part of the coil 28, so that the heat dissipation characteristic from the coil 28 to the outside is improved.

EXPLANATION OF REFERENCE NUMERALS

10 REACTOR; 12 REACTOR CORE; 14 CORE MEMBER; 16 FIRST LEG PART; 18 SECOND LEG PART; 16*a*, 18*a* END SURFACE OF LEG PART; 20 CONNECTING SECTION; 22 PRIMARY INSERT-MOLDED RESIN PART; 24,25 LEG COVERING SECTION; 26 WALL SECTION; 28 COIL; 28*a*, 28*b* COIL SECTION; 29*a*, 29*b* CONDUCTOR END; 30 GAP PLATE; 31 GAP SECTION, 32 ADHESIVE LAYER; 34 SECONDARY INSERT-MOLDED RESIN PART; 38 ATTACHMENT SECTION; 40 BOLT PASSING HOLE; 42 HEAT DISSIPATION SHEET; 44 REACTOR ATTACHMENT MEMBER OR BOTTOM PLATE OF METAL CASING; 46 BOLT; 48 FEMALE THREADED HOLE; 50*a*, 50*b* ATTACHMENT RECESS; 52, 54 JOINT SECTION; 56*a* OUTER STEP; 56*b* INNER PROJECTION; 56*c*, 58*c* CHANNEL SECTION; 58*a* INNER STEP; 58*b* OUTER PROJECTION; 60 GAP

The invention claimed is:

1. A reactor comprising:

a reactor core in which two U-shaped core members, each of which is integrally formed by a magnetic material, are connected in a ring shape with gap sections including adhesive layers therebetween;

a primary insert-molded resin part which is provided covering at least outer periphery surfaces of leg parts of the core member other than adhesion surfaces of the core members and which includes joint sections formed around end surfaces of the leg parts which form the adhesion surfaces;

a coil which is placed around the gap sections and the leg part of the core member; and a secondary insert-molded resin part which is made of a thermoplastic resin and which is insert-molded around the coil to fix the coil on the reactor core and fix the leg parts of the two core members in a connected state, wherein the joint sections of the primary insert-molded resin parts are fitted to each other in a state where the core members are placed connected in a ring shape, to form a peripheral wall surrounding the gap section, and the peripheral wall is formed by a frame shaped inner recess formed on one of the two joint sections, and a frame shaped projection formed on the other joint section, being fitted to each other, and wherein a gap for venting air from the gap section is formed between the inner recess and the projection which are recess-projection fitted to each other, and a size of the gap is set to a size which allows discharge of the air from the gap section, but prevents easy intrusion of melted thermoplastic resin for the second insert-molded resin part.

2. The reactor according to claim 1, wherein the adhesive layer is formed with a thermosetting adhesive, and the adhesive layer is cured using heat during the formation of the secondary insert-molded resin part.

3. The reactor according to claim 1, wherein a bottom surface of the inner recess and a tip surface of the projection are brought into contact with each other, to define a size of the gap section.

4. The reactor according to claim 3, wherein the gap section is formed with only the adhesive layer.

5. The reactor according to claim 1, wherein a channel section into which redundant adhesive can enter from the gap section is formed on at least one of a bottom surface of the inner recess and a tip surface of the projection.

6. The reactor according to claim 1, wherein of two leg parts of one of the U-shaped core members, the inner recess is formed on the joint section of the primary insert-molded resin part of one of the leg parts and the projection is formed on the joint section of the primary insert-molded resin part of the other leg part.

* * * * *